United States Patent [19]

Alibert

[11] Patent Number: 4,781,617

[45] Date of Patent: Nov. 1, 1988

[54] CABLE CONNECTOR ARRANGEMENT TO ACCOMMODATE MULTIPLE CABLE SIZES

[76] Inventor: Vernon F. Alibert, Misty Hollow RD #3, Glens Mills, Pa. 19342

[21] Appl. No.: 34,008

[22] Filed: Apr. 2, 1987

[51] Int. Cl.[4] ..... H01R 13/59

[52] U.S. Cl. ..... 439/461

[58] Field of Search ..... 439/461-463, 439/472, 459, 469, 393

[56] References Cited

U.S. PATENT DOCUMENTS

| | | | |
|---|---|---|---|
| 3,188,380 | 6/1965 | Lorenz | 439/393 X |
| 3,437,980 | 4/1969 | Smith | 439/469 |
| 4,114,974 | 9/1978 | Lawrence | 439/462 |
| 4,145,075 | 3/1979 | Holzmann | 439/461 |

*Primary Examiner*—Eugene F. Desmond

*Attorney, Agent, or Firm*—William E. Cleaver

[57] ABSTRACT

The present arrangement includes a support member which is formed to: (1) have tines extending from one end; and (2) have a threaded section lying adjacent to the beginning of the tines. In addition the present arrangement in the preferred embodiment includes a rubberized cone shaped insert which has an aperture therethrough and which enables a great number of different sized cables to be clamped. Further in addition there is included a compression nut which is internally threaded in one section, which is shaped internally concave in another section (and which has an aperture therethrough), and which is threaded onto said support member. Such threading action causes the tines to be bent inward toward one another and simultaneously to pass through the aperture of the compression nut. The tines are serrated on their respective inner surfaces and as they are bent toward each other they come in contact with the rubberized insert and act to clamp thereon which in turn secures the support member to a cable jacket. In addition, the present arrangement has a plug body, which in a preferred embodiment, is: (1) cylindrical in shape; (2) has a key protrusion disposed axially and internally along the plug body wall, and (3) has an internal key protrusion disposed around the perimeter thereof. Further in addition the present arrangement includes a plastic insert device which has a plurality of female receptacles therein and which has a first keyway to match the axial key and a second keyway to match the perimeter key. Accordingly when the insert is inserted into the plug body the insert is prevented from rotational movement as well as axial movement.

8 Claims, 2 Drawing Sheets

CABLE CONNECTOR ARRANGEMENT TO ACCOMMODATE MULTIPLE CABLE SIZES

BACKGROUND OF THE DISCLOSURE

The use of cables for signal transmission paths is well understood in the communication art. The use of cable connectors for connecting such cables to circuit boards and the like is also well understood. The more miniaturized the communication systems have become, the more difficult it has become to keep the many wires of the cable secured to a connector device. In the prior art, the many wires of the cable are connected to a connector by soldering the wires of the cable to a plurality of solder pots. Solder pots are the ends of connectors which protrude from a receptacle holder. The connector normally has a housing which holds the receptacle holder and that housing is clamped to the cover of the cable in two principal ways. The first principal way is to crimp the ends of the housing to the cable cover and the friction of the "pushed in" section of the housing clamps the housing in position to the cable. An alternative practice in the prior art has been to use a cylindrical clamp which has screws passing therethrough orthogonally to the cable cover. As the screws are tightened, or threaded inward, the ring more firmly grasps the cable cover. In such prior art practices a special tool has been required in order to effect crimping and neither of the techniques prevent rotation of the receptacle holder within the housing nor do such techniques prevent axial movement of the receptacle holder within the housing. Accordingly, any strains on the cable connection per se are transmitted to the solder connections and can cause those connections to break in response to a twisting motion of the cable or in response to a pulling effort on the cable.

The present arrangement provides a simplified means for clamping a housing to a cable cover without requiring special tools, provides a clamping arrangement which can accommodate many different sizes of cables, and further provides a means for preventing both rotational and axial movement of the receptacle holder with respect to the housing.

SUMMARY OF THE INVENTION

In a preferred embodiment, the present arrangement includes a support member which has an externally threaded section. Extending from the threaded section is a plurality of tines. Each of the tines, of course, have a secured end and each has a free end. The free ends of a group of 75 tines, in the preferred embodiment, define a circle. In order to accommodate a number of different sizes of cables there is further included a cone shaped rubberized insert which has an aperture therethrough. Since the rubber is resilient, stretchable and/or compressible the aperture wall can be compressed to accommodate different sizes of cables which are passed therethrough. The rubberized insert is designed to fit within the tines. In addition, there is employed (with the support member) a compression nut. The compression nut is internally threaded with a pitch that matches the external thread of the support member. Further in addition to the internal threading, the compression nut has a section with a concave inside surface configuration. Accordingly as the compression nut is threaded onto the support member, the tines move along the concave surface and are pushed downward toward the center thereof. The compression nut has an aperture therethrough including its end, so that when the tines, as they move downward, strike the rubberized insert, they bite into the rubberized wall and pass through the aperture. The tines are formed to have serrations on the inside surfaces thereof and these serrations assist in the clamping, or biting, effect of the tines. The radius of the concave configuration is chosen such that a thumb tight effort by a human being will fully thread the compression nut to the support member and simultaneously provide a very acceptable clamping of the support member to the rubberized insert which in turn secures the support member to the cable. While I have discussed the insert as being rubberized, the insert could be a material such as PVC tubing which in its cold state is resilient and compressible and which can be heat shrunk to seal around the cable.

The present arrangement further includes a plug body which can be formed integral with the support member or can be formed to be threaded onto the support member. The plug body, in one embodiment, has an external thread made part thereof and has a section which is substantially cylindrical in shape. When the threaded section of the plug body is threaded onto the support member there is an aperture formed through the support member and through the plug body. The cylindrically shaped section has a first key protrusion disposed to lie internally and axially, as well as a second key protrusion which is disposed to lie internally and circumferentially. The overall arrangement includes a Teflon material (Teflon is a Registered Trademark of the E. I. Dupont Company) insert which holds a plurality of female receptacles. The female receptacles are open ended and flush with one end of the Teflon material insert while such receptacles protrude from the other end of the Telfon material insert and form solder pots. The Teflon material insert has an axial keyway to match the axial key of the plug body and a circumferential keyway to match the circumferential key of the plug body. When a cable is to be connected with the connector just described, the many wires of the cable are soldered to the solder pots and then the cable is carefully pulled so that the Teflon material insert snaps into the cylindrical section by having the axial keyway in the insert fitted with the axial key of the plug body and the circumferential keyway of the insert gets fitted with the circumferential key of the plug body. Accordingly any tugs or twists which are applied to a cable connected to the insert only cause a stress on the insert which cannot move either rotationally or axially. Hence, the solder joints are protected.

The features and objects of the present invention will be better understood in accordance with the following description taken in conjunction with the drawings wherein.

Figure 1:
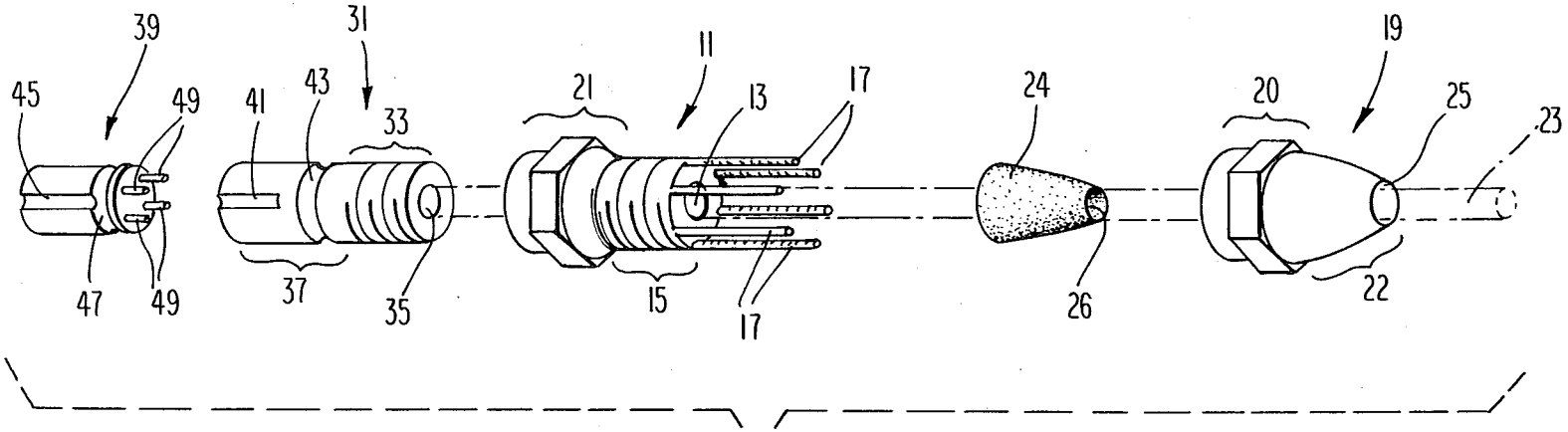
FIG. 1 is an exploded view depicting the compression nut, a cone shaped insert, the support member, the plug body and the wire holder insert.

Consider FIG. 1. In FIG. 1 there is shown a support member 11 which has an aperture 13 passing therethrough. The support member has a threaded section 15. As can be gleaned from FIG. 1 a plurality of tines or prongs 17, protrude from the threaded section 15. Each of the prongs, or tines 17, has a secured end which is secured to the body of the support member section adjacent to the threaded section 15 and each of the tines has a free end which lies away from the threaded section 15. As can be noted in FIG. 1, there is a space between each of the adjacent tines. As will become more apparent hereinafter, the spaces between the adjacent tines are useful to enable the tines to be reformed as they pass through the compression nut 19. In the particular embodiment shown in FIG. 1, the support member 11 has an internally threaded section within the takeup section 21.

As mentioned above, in FIG. 1 there is shown a compression nut 19. The compression nut 19 has an internally threaded section 20 and an internally formed concave section 22 which will be better appreciated in FIG. 2. The compression nut 19 also has an aperture 25 which passes through both of the sections 22 and 20.

Figure 5:
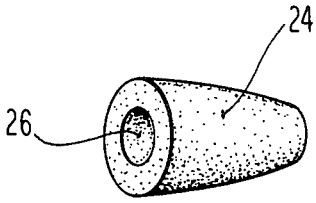
FIG. 5 depicts the cone shaped clamping insert.
Figure 6:
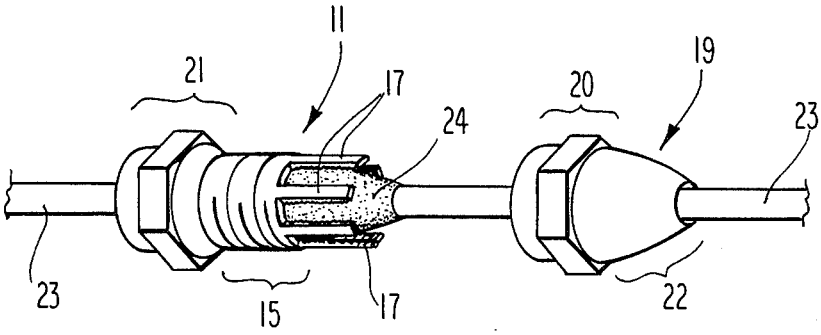
FIG. 6 shows the cone shaped clamping insert located on a cable and grasped by the tines.

When the support member 11 is to be clamped to a cable such as cable 23 (shown in phantom), the compression nut 19 is first threaded onto the cable such as shown in FIG. 1. Next, the cone shaped insert 24, shown in FIG. 5, is threaded over the cable 23 as shown in FIG. 6. In the preferred embodiment, the cone shaped clamping insert 24 is fabricated from rubber and is of course resilient, stretchable and compressible. As the cable 23 is passed through the aperture 26 of the cone shaped clamping insert, the inner wall is compressed (i.e. the wall gives way to accept the cable 23). When the cable 23 is no longer being pulled through the aperture 26 the inner wall pushes back toward the center of the aperture and frictionwise secures the cone shaped clamping insert 24 to the cable 23. It should be understood that while I refer to a cone shaped rubberized insert, in the preferred embodiment, other forms of inserts could be used such as cylindrically shaped pieces of PVC tubing which is heat shrunk to be sealed to the cable.

Figure 2:
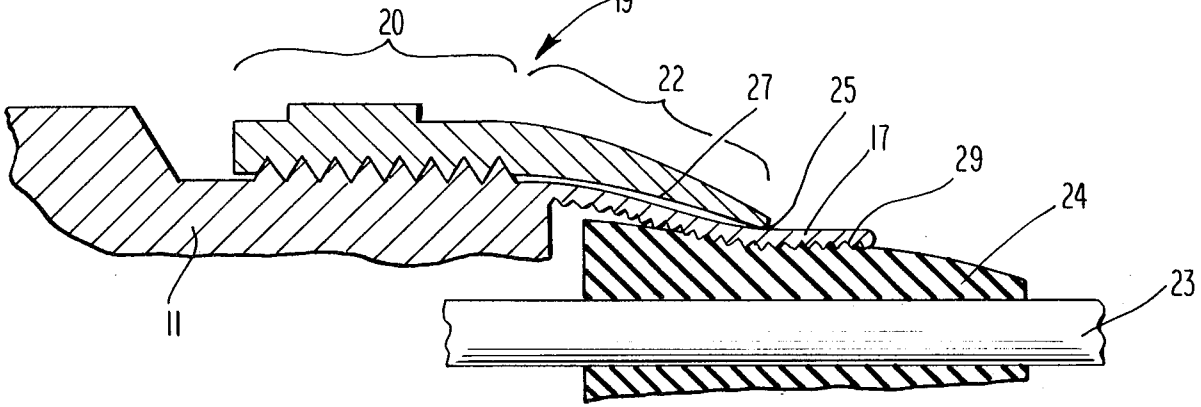
FIG. 2 is a sectional view of a portion of the compression nut, a tine and the cone shaped insert clamping.

Next, the support member 11 is threaded onto the cable 23. The support member 11 is located so that the tines encompass at least part of the cone shaped clamping insert 24. Thereafter the compression nut 19 is passed over the cone shape clamping insert 24 and over the tines 17 and the internally threaded section 20 is threaded onto the externally threaded section 15 of the support member 11. As the compression nut 19 is threaded onto the support member 11, the tines are pushed inward toward the axis of the aperture 13 (in FIG. 1) and that inward travel is interrupted when the tines come into contact with the clamping insert 24. This action can be better appreciated from FIGS. 2 and 6. In FIG. 2 portions of sections 20 and 22 are shown as part of the cross-section of the compression nut 19. In addition in FIG. 2 a cross-sectional portion of support member 11 is shown. In FIG. 2 the compression nut 19 is shown fully threaded onto the support member 11. It can be readily envisioned from FIG. 2 that as the compression nut 19 is moved to the left in the drawing (and as it was taken up by the threaded section 15), the tine 17 first bumped into the concave surface 27 of section 22 and was forced downward until it exited from the aperture 25. While the surface 27 is shown to be concave, it should be understood that it could be a slope. As the tine 17 passed through the aperture 25 its downward movement was stopped as it came into contact with the clamping insert 24. As can be discerned in FIG. 2, the underside of the tine 17 is serrated with the serrations 29. The serrated tine 17 grips into the clamping insert 24 and thus the tine 17 (along with other such tines) clamps the support member 11 to the clamping insert 24 which in turn is friction secured to the cable 23. The radius of the concave surface 27 is chosen so that the compression nut 19 can be taken up to its fully threaded position, such as shown in FIG. 2, with simply the thumb and forefinger pressure of a human being. In other words there are no special tools necessary to clamp the support member 11 onto the cable 23. The compression nut 19 stays in the position shown in FIG. 2 as part of the connector assembly. The upward limit of the diameter of the cable that can be accommodated by the support member 11 and the compression nut 19 is determined by the size to which the aperture 26 can be opened as well as the size of the clamping insert that can be located in the tines. Obviously for larger cable sizes there would be a larger support member, a larger compression nut, and a larger rubberized clamping insert. For smaller cable sizes there could be a smaller size support member, a smaller size compression nut and a smaller rubberized clamping insert. However for a given rubberized clamping insert, a large number of different cable sizes can be accommodated.

Figure 3:
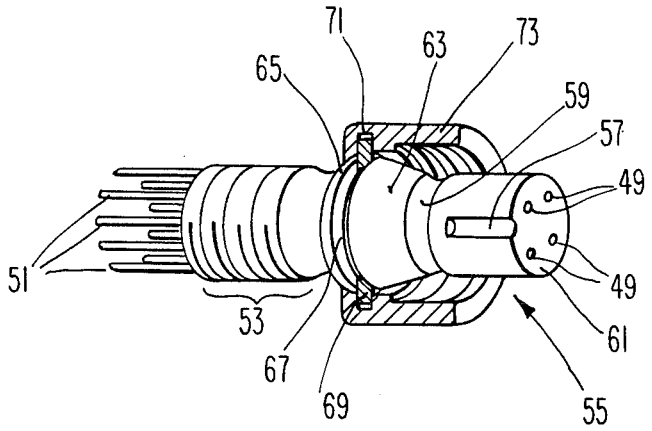
FIG. 3 depicts a second embodiment of the support member and plug body with a captured nut thereon.

In FIG. 1 there is also shown a plug body 31 which has an externally threaded section 33 and an aperture 35 passing therethrough. As is shown in FIG. 1 there is a second section 37 (insert housing) of the plug body 31 which houses the insert 39. It will be noted that the insert housing 37 has a key 41 formed to provide an internal protrusion into the housing. It also can be determined from FIG. 1 that the insert housing section 37 has a circumferential key 43 which provides an internal protrusion in a circumferential manner within the insert housing 37. Examination of the insert 39 in FIG. 1 reveals that the insert has a matching keyway 45 which matches the key 41 and a circumferential keyway 47 which matches the key 43. Accordingly, when the insert is pushed into the insert housing section 37, i.e., pushed rightward in FIG. 1, the key 43 snaps into the keyway 47 and the key 41 is fitted into the keyway 45. Accordingly the insert cannot be rotationally moved because of the key 41 and the keyway 45 and the insert 39 cannot be axially moved because of the key 43 being fitted into the keyway 47. The means to lock the insert into the insert housing is very important because the insert 39 is connected to another cable, or some backboard wiring, or some circuit cards, or the like, by the female ends of the receptacles 49. The female ends of the receptacles 49 can be seen in FIG. 3 and are marked 49 in FIG. 3. In the prior art, as mentioned earlier, if a cable, which was connected to the female inserts, were twisted it would cause the insert to twist. In response the weakest point of the connected system would be damaged, namely the point at which the receptacles 49 in FIG. 1 were soldered to wires coming from the cable 23. In the present arrangement if a cable is connected to the receptacles 49, as shown in FIG. 3, were to be twisted, or jerked back and forth laterally there would be no effect on the solder connections which connect the wires of the cable 23 to the protruding receptacles 49 in FIG. 1. As mentioned above the insert 39 cannot be rotated nor can it be moved axially so that the insert itself takes up all the strain and stress applied by movement of any cable attached thereto.

Prior to insert 39 being inserted into the housing section 37, the plug body 31 is threaded into the support member 11 in particular into the internally threaded section 21. Accordingly the plug body and the support member become in effect a single structure. Thereafter the cable which has been soldered to the solder pots 49 is pulled rightward and the insert 39 is snapped into the insert housing section 37 with the key 43 being fitted into the keyway 47 and the key 41 being fitted into the keyway 45. When the plug body 31 has been assembled with the support member 11 which in turn has been coupled to the compression nut 19 and the insert 39 is located in the housing section 37, then the five parts shown in FIG. 1 are assembled together as a single connector assembly.

Figure 4:
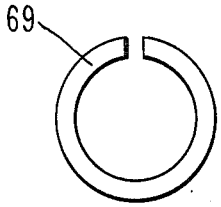
FIG. 4 depicts a ring which is used to effect the placement of the captured nut of FIG. 3.

FIG. 3 depicts a second embodiment of the connector assembly. In FIG. 3 there is shown a plurality of tines 51 which are connected as described earlier to an externally threaded section 53. However, instead of the externally threaded section 53 being formed integral with an internally threaded take up section 21 as was shown in FIG. 1, in FIG. 3 the externally threaded section 53 is formed integral with a plug body 55. The axial key 57 and the circumferential key 59 are analogous to the keys 41 and 43 as described earlier. As can be seen in FIG. 3 the insert 61 is already snapped into position as was described in connection with the insert 39 and the insert housing section 37 of FIG. 1. However, note in FIG. 3 that there is a ramp structure 63 and a ring structure 65 which defines therebetween a groove 67. The groove 67 is formed to hold a ring 69 which can be better seen in FIG. 4. The ring 69 is initially slipped into a groove 71 of the captured nut 73. When the ring 69 is located in the groove 71 of the captured nut 73, the captured nut is slipped over the ramp section 63 and the spring 69 is spread apart to permit the captured nut to slide from right to left. When the ring goes over the peak of the ramp 63 it snaps back into its former position and fits into the groove 67. However, the groove 67 is formed to provide a larger diameter than that shown in FIG. 4. Hence the ring 69 is somewhat spread and extends over the edge of the ramp and over the edge of the ring device 65. Accordingly the ring 69 is partially in the groove 71 of the captured nut 73 and partially in the groove 67. Accordingly the captured nut 73 can rotate but it cannot experience any axial movement. Since the captured nut 73 is rotatable, a threadable piece which would connect a cable to the inserts 49 of FIG. 3 can be drawn inward, that is from right to left in FIG. 3 by rotating the nut 73. Therefore a cable which is going to be connected to the female inserts 49 can be drawn up or drawn toward those female inserts to make a solid connection by rotating the captured nut 73.

The present device enables the user to simply clamp a portion of the assembly to the cover of a wire by virtue of threading the compression nut on the externally threaded section 15 of the support element. As described earlier when the compression nut is so threaded it forces the tines downward and in abutment with the insert which in turn is friction secured to the cable. The serrated surfaces of the tines grip the rubberized insert and hence a good clamp of the assembly to the cable cover if effected. Such clamping action of course limits the translation of any axial movement of the cable to any soldered wires within the assembly. In addition such a clamp limits the translation of the rotational movement of the cable 23 which also would damage the solder connections of the individual wires. Although there is a provision for using a wrench on the compression nut or a wrench on the support element, in actual practice the need for such wrench activity has been found unnecessary. In the second embodiment of the present invention the means for quickly capturing a rotatable nut by virtue of the ring 69 enables a second embodiment of the present device to be used wherein the cable to be connected includes a threaded drawup mechanism.

The insert housing section of the plug body with its axial key and its circumferential key along with the insert 39 with its axial keyway and its circumferential keyway limit the translation of any motion both axially and rotationally which might originate from the cable to which the assembly was connected (through the female receptacles 49) from being in any way damaging to solder connections at the solder pots 49 shown in FIG. 1.

It should be understood that the compression nut and the support element and the plug body can be fabricated from any suitable metal and in the preferred embodiment are fabricated from a brass alloy. The insert 39 in the preferred embodiment is fabricated from Teflon material although other plastic or ceramic inserts can be used. The insert 24 in the preferred embodiment is fabricated from rubber but other forms of material which are characterized by being resilient, stretchable and compressible could be used and the insert need not be cone shaped but could have different sized outside diameters if necessary.

I claim:

1. Means to secure a connector assembly to a cable, comprising in combination: support means having an externally threaded section; a plurality of finger like structure means, each having a secured end formed integral with said support means and disposed so that when viewed together said secured ends define an endless configuration, each of said finger like structure means having a free end and disposed so that a space is formed between each of said finger like structure means and any adjacent ones of said finger like structure means said finger like structure means being formed of a bendable brass alloy; clamping insert means having first and second ends and fabricated of material having a resilient, compressible and stretchable nature, said clamping insert means formed to have an aperture therethrough of such dimension that a cable passing therethrough will be firmly secured to said clamping insert means, said clamping insert means further formed and disposed so that when a cable is passed through said aperture said clamping insert means is fittable at least partially within said plurality of finger like structure means and with its first end located approximately opposite the free ends of said finger like structure means; compression nut means having first and second sections and formed to be internally threaded within said first section and formed to have an internally concave surface in said second section, said compression nut means further formed to have a sufficiently large aperture at the end of said second section whereby in the course of said compression nut means having its first section threaded onto said externally threaded section of said support means said first end of said clamping insert means passes through said aperture and whereby said finger like structure means are bent inwardly to follow said internally concave surface toward said clamping insert means and pass through said aperture of said compression nut toward the center thereof to effect a clamping action on said clamping insert means to in turn clamp said support means to said cable.

2. Means to secure a connector assembly according to claim 1 wherein said clamping insert means is fabricated from rubber and is cone shaped.

3. Means to secure a connector assembly according to claim 1 wherein each of said finger like structure means has a side thereof, which lies away from said internal concave formation, formed to be serrated whereby said clamping action is increased.

4. Means to secure a connector assembly according to claim 1 wherein each of said finger like structure means has a sufficient length so that said finger like structure means pass a substantial distance through said aperture of said second section of said compression nut means.

5. Means to secure a connector according to claim 1 wherein said support means further includes a take up section which is connected to said externally threaded section and which is internally threaded so that further devices can be threaded into said take up section.

6. Means to secure a connector according to claim 1 wherein said support means further includes a take up section wherein there is disposed a captured nut means that is mounted to rotate in a fixed position and which is formed to be threaded internally so that a threaded device can be pulled toward said support means in response to rotating said captured nut.

7. A cable connector assembly comprising in combination: support means having an externally threaded section; a plurality of finger like structure means, each having a secured end formed integral with said support means and disposed so that when viewed together said secured ends define an endless configuration, each of said finger like structure means having a free end with said free ends disposed so that a space is formed between each of said finger like structure means and any adjacent ones of said finger like structure means, said finger like structure means being formed of a bendable brass alloy; clamping insert means fabricated of material having a resilient, compressible and stretchable nature, said clamping insert means formed substantially cone shaped with a base end and an apex end and having an aperture formed to run from said apex end through said base end with said aperture being of such dimension that a cable passing therethrough will be firmly secured to said clamping insert means, said clamping insert means further formed and disposed so that when a cable is passed through said aperture said clamping insert means is fittable at least partially within said plurality of finger like structure means and with its apex end located approximately opposite said free ends of said finger like structure means; compression nut means having first and second sections and formed to be internally threaded within said first section and formed to have an internally concave surface in second section, said compression nut means further formed to have a sufficiently large aperture at the end of said second section whereby in the course of said compression nut means having its first section threaded onto said externally threaded section of said support means said apex end passes through said aperture and whereby said finger like structure means are bent inwardly to follow said internally concave surface toward said clamping insert means and pass through said aperture toward the center thereof to effect a clamping action on said clamping insert means to in turn clamp said support means to said cable; plug body means having a connecting section and a substantially cylindrical section with an elongated aperture therethrough, said plug body means connected onto said externally threaded section of said support means and disposed to hold said substantially cylindrical section away from said finger like structure means; and insert means having at least one female receptacle means disposed therein, said insert means formed to fit into said substantially cylindrical section for connection to a cable means when said cable means pass through said aperture of said compression nut and through said support means into said plug body means.

8. A cable connector assembly comprising in combination: support means having an externally threaded section; a plurality of finger like structure means, each having a secured end formed integral with said support means and disposed so that when viewed together said secured ends define an endless configuration, each of said finger like structure means having a free end with said free ends disposed so that a space is formed between each of said finger like structure means and any adjacent ones of said finger like structure means, said finger like structure means being formed of a bendable brass alloy; clamping insert means fabricated of material having a resilient, compressible and stretchable nature, said clamping insert means formed substantially cone shaped with a base end and an apex end and having an aperture formed to run from said apex through said end with said aperture being of such dimension that a cable passing therethrough will be firmly secured to said clamping insert means, said clamping insert means further formed so that when a cable is passed through said aperture said clamping insert means is fittable within said plurality of finger like structure means; compression nut means having first and second sections and formed to be internally threaded within said first section and formed to be internally concave in said second section, said compression nut means further formed to have a sufficiently large aperture at the end of said second section whereby in the course of said compression nut means having its first section threaded onto said externally threaded section of said support means said apex end passes through said aperture and whereby said finger like structure means are bent inwardly to follow said internally concave surface toward said clamping insert means and pass through said aperture toward the center thereof to effect a clamping action on said clamping insert means to in turn clamp said support means to said cable; plug body means being substantially cylindrical in shape and formed integral with said support means and disposed to lie away from said finger like structure means; insert means having at least one female receptacle means disposed therein, said insert means formed to fit into said plug body means for connection to a cable means passing through said aperture of said compression nut and through said support means into said plug body means.

* * * * *